US005383435A

United States Patent [19]

Phillips

[11] Patent Number: 5,383,435

[45] Date of Patent: Jan. 24, 1995

[54] FUEL PUMPING APPARATUS

[75] Inventor: Ronald Phillips, Middlesex, England

[73] Assignee: Lucas Industries, England

[21] Appl. No.: 185,782

[22] PCT Filed: Jul. 31, 1992

[86] PCT No.: PCT/GB92/01414

§ 371 Date: Jan. 21, 1994

§ 102(e) Date: Jan. 21, 1994

[87] PCT Pub. No.: WO93/03270

PCT Pub. Date: Feb. 18, 1993

[30] Foreign Application Priority Data

Aug. 6, 1991 [GB] United Kingdom ..... 9116918

[51] Int. Cl.[6] ..... F02M 41/14

[52] U.S. Cl. ..... 123/450; 123/617; 324/174

[58] Field of Search ..... 324/173, 174, 178, 179, 324/207.12, 207.25, 378, 207.15; 123/449, 450, 494, 617

[56] References Cited

U.S. PATENT DOCUMENTS

| | | | |
|---|---|---|---|
| 4,442,822 | 4/1984 | Kondo et al. | 123/617 |
| 4,531,491 | 7/1985 | Iiyama et al. | 123/450 |
| 4,538,580 | 9/1985 | Straubel et al. | 123/450 |
| 4,608,958 | 9/1986 | Sakakibara et al. | 123/605 |
| 4,677,378 | 6/1987 | Tokura et al. | 123/617 |
| 5,021,736 | 6/1991 | Gonsalves et al. | 123/174 |
| 5,097,209 | 3/1992 | Santos | 123/617 |
| 5,107,211 | 4/1992 | Rose | 324/207.25 |
| 5,111,098 | 5/1992 | Peck et al. | 123/174 |

*Primary Examiner*—E. Rollins Cross
*Assistant Examiner*—Thomas N. Moulis
*Attorney, Agent, or Firm*—Andrus, Sceales, Starke & Sawall

[57] ABSTRACT

A fuel pump for supplying fuel to an engine includes a rotary drive shaft (12) having an enlarged portion (18) through which the rotary part of the pump is driven. The pump also has an annular cam ring (17) which is angularly adjustable within the pump housing to vary the timing of fuel delivery. The pump includes a transducer (31) having pole pieces (33, 34) which are located in close proximity to the elongated portion (18) of the drive shaft. The pole pieces form part of a magnetic circuit including a magnet and the pole piece (33) and the adjacent surface or the portion (18) are shaped so that the flux in the magnetic circuit varies in a cyclic manner as the shaft rotates. The pole pieces and magnet are mounted on the cam ring (17) and the transducer includes a former (37) carried by the housing of the pump and upon which is wound a winding. The former surrounds a part of the magnetic circuit and the former and the part of the magnetic circuit are shaped so as to allow angular movement of the cam ring.

9 Claims, 5 Drawing Sheets

FUEL PUMPING APPARATUS

This invention relates to a fuel injection pumping apparatus for supplying fuel to an internal combustion engine the apparatus being of the kind comprising a housing, a cam actuated pumping plunger slidable in a bore, means for distributing fuel discharged from the bore during successive inward movements of the plunger, to a plurality of outlet ports in turn, a plunger actuating mechanism comprising a first part which is mounted for rotation in the housing and which in use is driven in timed relationship with an associated engine to actuate the plunger, and a second part mounted in the housing and being angularly adjustable therein about the axis of rotation of the first part, to enable the timing of inward movement of the plunger to be varied and a transducer mounted on said second part and responsive to indicia on said first part.

An apparatus of the aforesaid kind is shown in GB-A-2086491 in which the first part carries cam followers located at the outer ends respectively of pumping plungers and the second part is a cam ring having cam lobes on its internal surface which are engaged by the cam followers. The transducer is carried by the cam ring and is of the variable reluctance type and is responsive to the passage of grooves which are formed in the surface of the first part. The transducer since it is mounted on the cam ring moves in the use of the apparatus about the axis of rotation of the first part as the timing of fuel delivery is adjusted. As a result it is necessary to provide a flexible connection to the transducer such a connection in practice extending between the transducer and a connector block mounted on the housing. The provision of the flexible connection presents practical difficulties and the object of the invention is to provide an apparatus of the kind specified in a simple and convenient form.

According to the invention in an apparatus of the kind specified the transducer comprises first and second pole components and a magnet acting to polarize said components to opposite magnetic polarity, the magnet and said components being mounted on said second part and forming a magnetic circuit with said first part, said first part and one of said components being shaped so that the flux flow in said magnetic circuit varies in a cyclic manner as the first part rotates in use, and a sensing coil mounted on the housing of the apparatus and surrounding a portion of the magnetic circuit to provide the output signal of the transducer.

Figure 1:
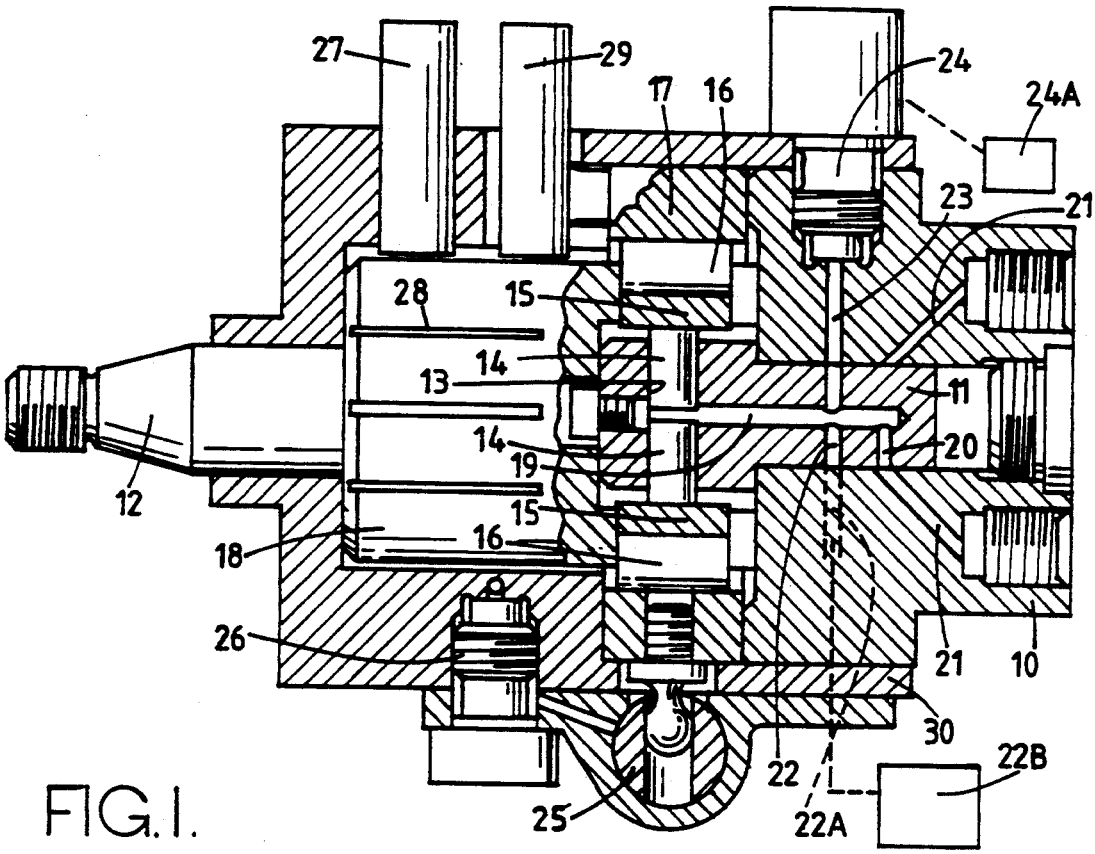
Figure 3:
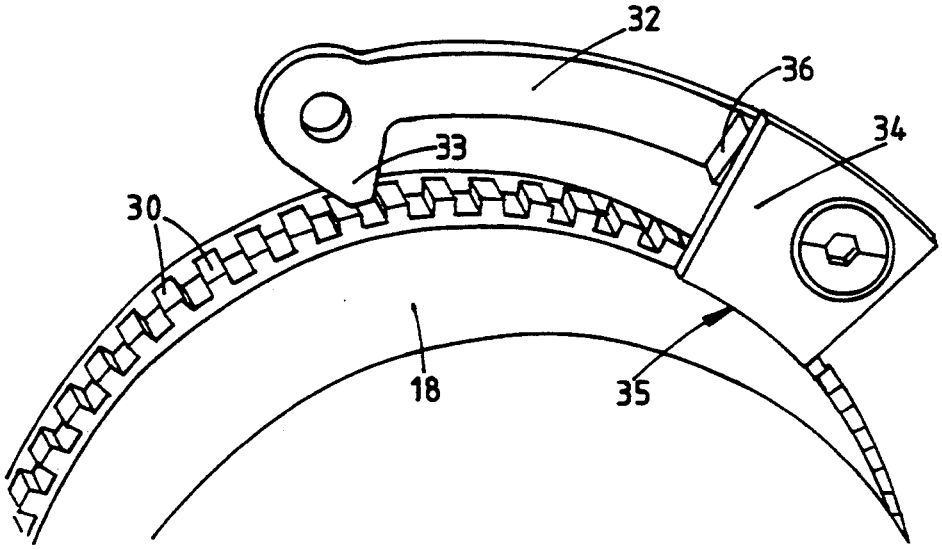
Figure 2:
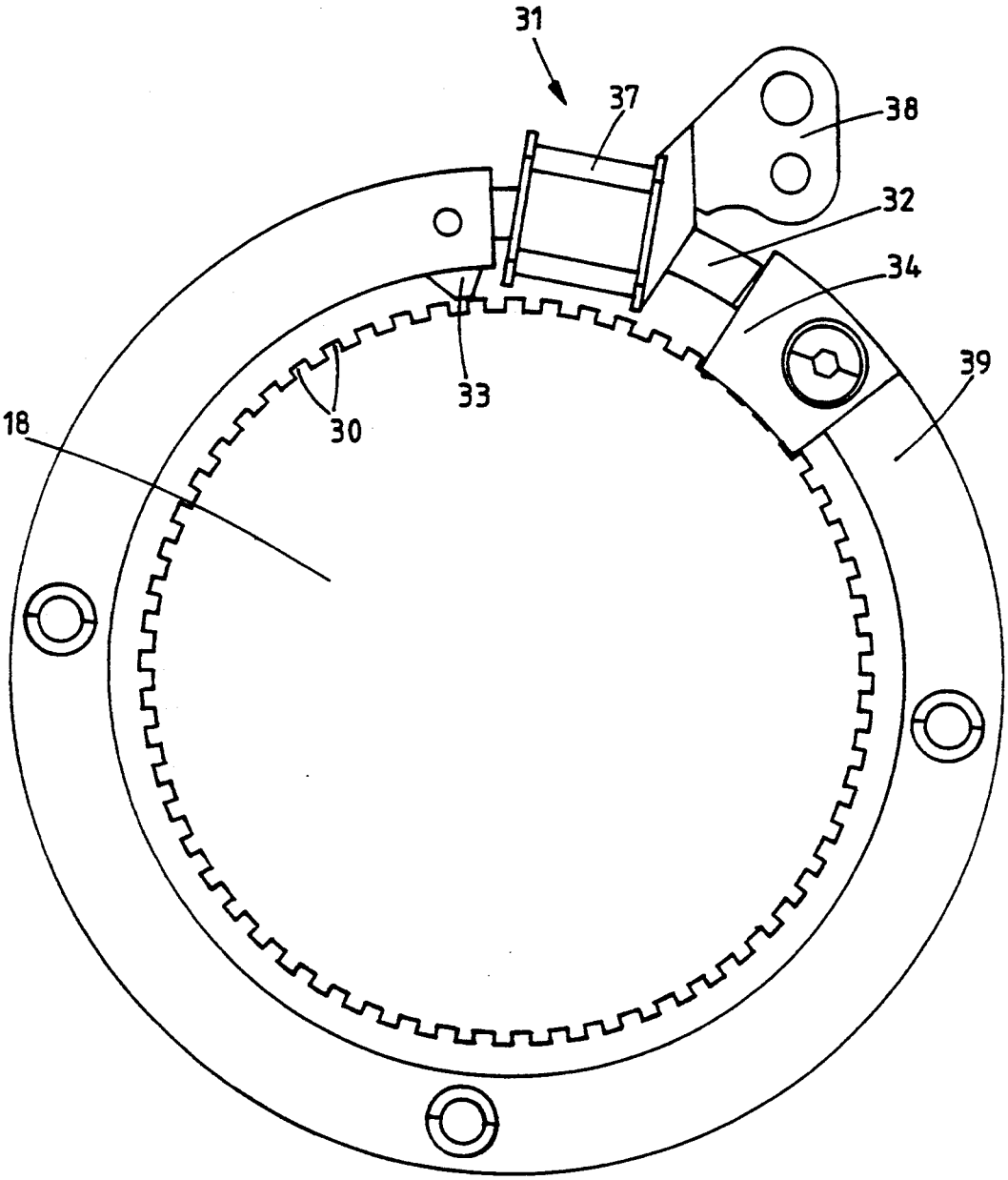
Figure 4:
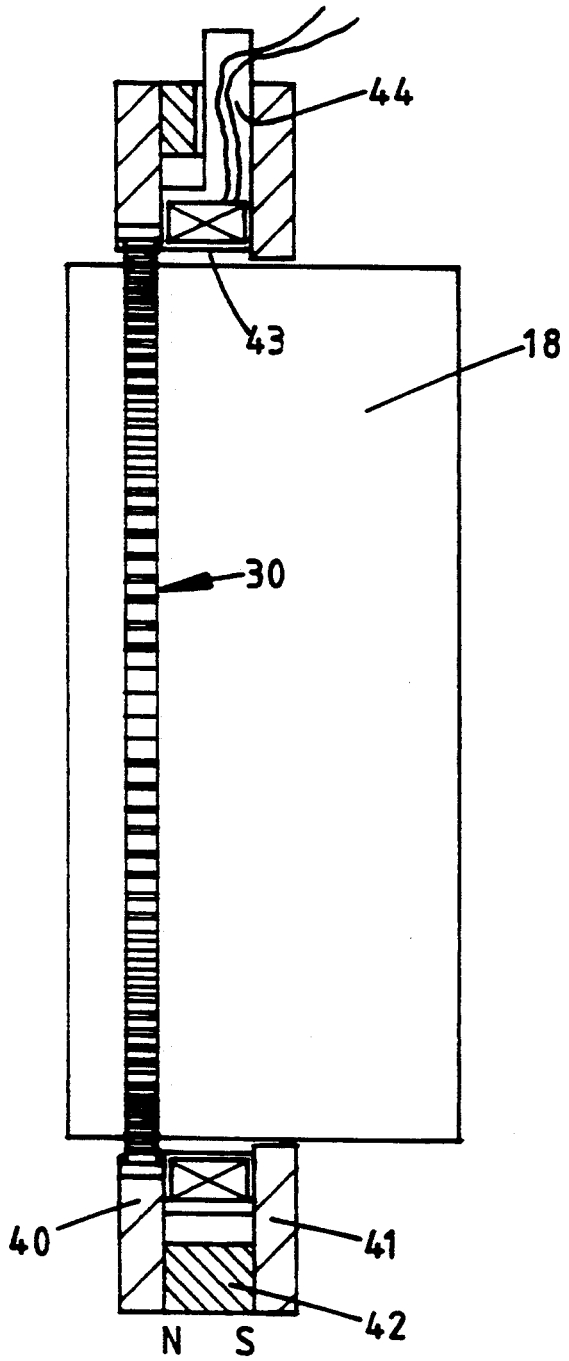
Figure 5:
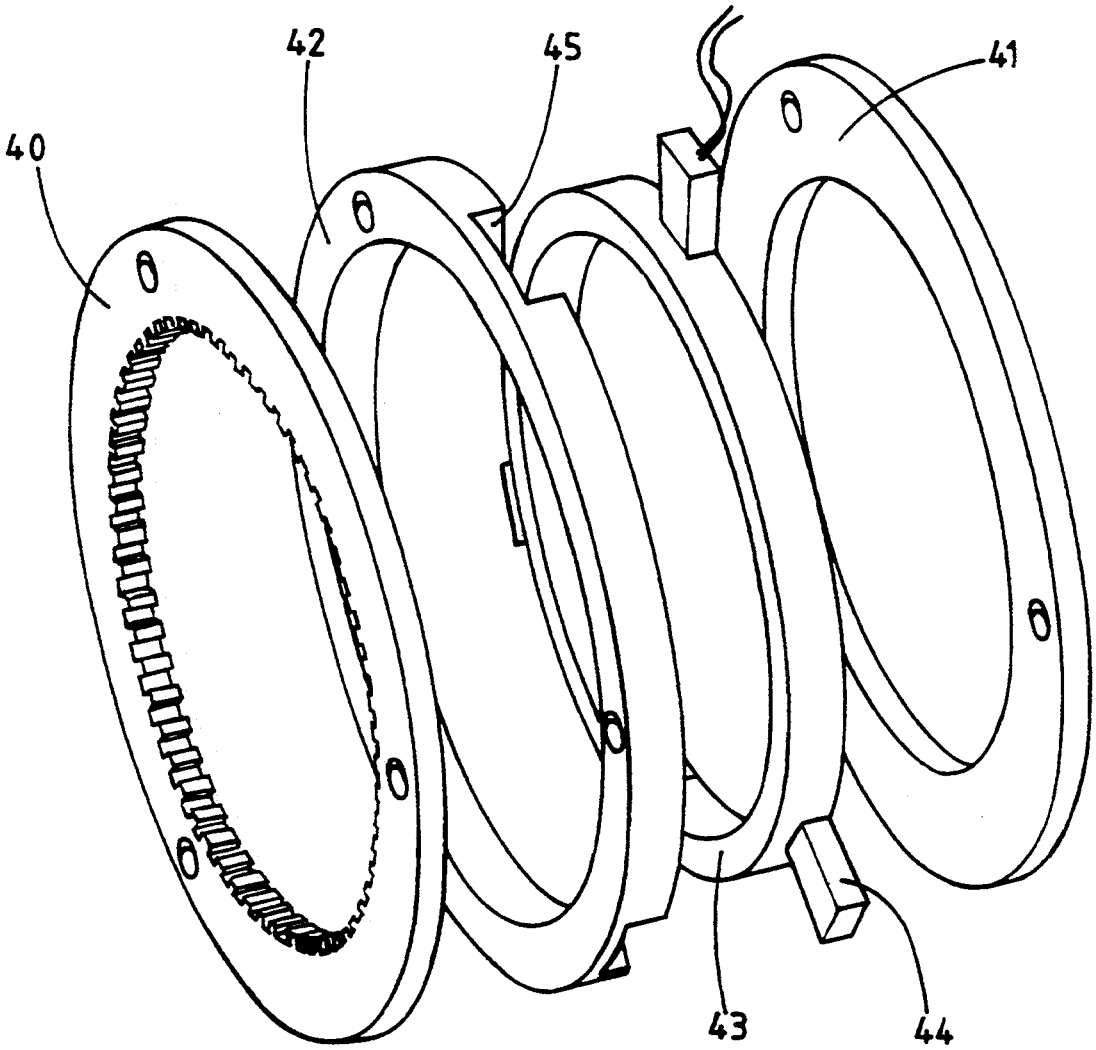
Figure 6:
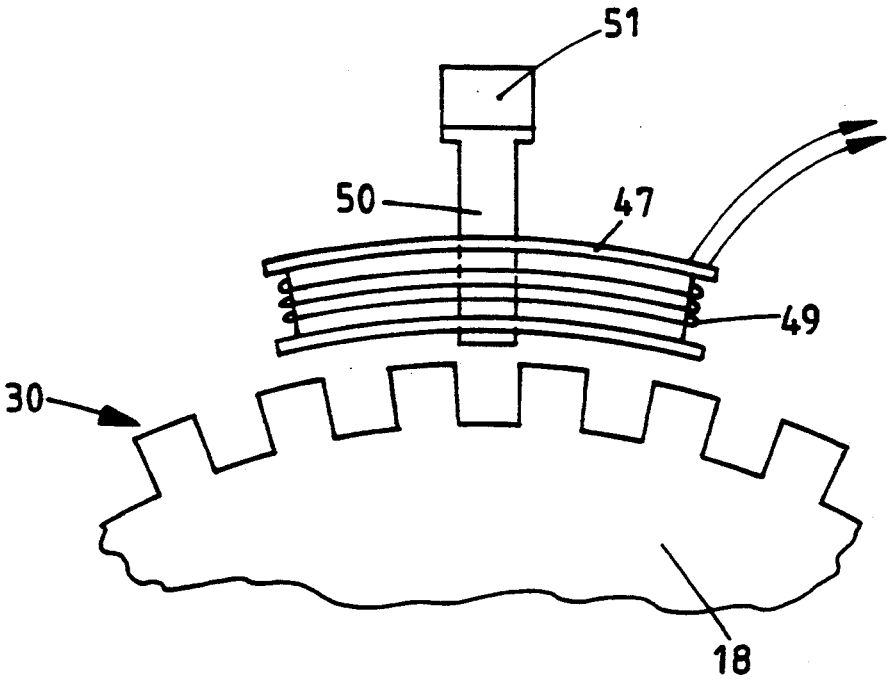
Figure 7:
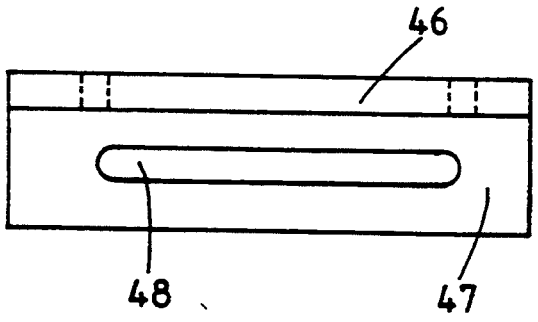

An example of a fuel pumping apparatus in accordance with the invention will now be described with reference to the accompanying drawings in which:

FIG. 1 is a diagrammatic sectional side elevation of a pumping apparatus generally of a known type, FIG. 2 is an end view with parts removed, showing a modified transducer in accordance with the invention, FIG. 3 is a perspective view with parts removed, showing the transducer of FIG. 2, FIG. 4 shows a sectional side elevation of another example of the transducer, FIG. 5 shows an exploded perspective view of the transducer of FIG. 4, FIG. 6 shows in diagrammatic form a side elevation of a further example of the transducer, and FIG. 7 shows a plan view of part of the transducer of FIG. 6.

Referring to FIG. 1 of the drawings the apparatus comprises a multi-part housing 10 in which is journalled a rotary cylindrical distributor member 11 which is coupled to so as to rotate with, a drive shaft 12 extending from the housing and arranged in use to be driven in timed relationship with the associated engine.

Formed in the distributor member is a transverse bore 13 in which is mounted a pair of pumping plungers 14. At their outer ends the plungers engage shoes 15 respectively which in turn carry rollers 16, the rollers and shoes constituting cam followers for engagement with the internal peripheral surface of a cam ring 17 mounted for angular adjustment within the housing.

Formed on the cam ring are a plurality of equi-angularly spaced cam lobes (not shown) and the cam followers are mounted in radially disposed slots which are formed in an enlarged portion 18 of the drive shaft which surrounds the distributor member.

Communicating with the bore 13 is a longitudinal passage 19 which in turn communicates with an outwardly extending delivery passage 20 which is arranged to register in turn as the distributor member rotates, with a plurality of outlet ports 21 which in use are connected to the injection nozzles of the associated engine. Also communicating with the passage 19 is a plurality of radially disposed inlet passages 22 and these can register in turn with an inlet port 22A which is formed in the housing 10 and which is in communication with the outlet of a source 22B of fuel under pressure. The pressure of fuel delivered by the source is arranged to vary in accordance with the speed at which the apparatus is driven.

The inlet ports 22 can also communicate in turn with a spill port 23 such communication being established during the time when the delivery passage 20 is in communication with an outlet port 21. The flow of fuel through the spill port 23 is controlled by an electrically operated spill control valve 24 the operation of which is controlled by an electrical control system 24A.

In operation, when the rollers 16 of the cam followers engage the leading flanks of the cam lobes, fuel will be displaced from the bore 13 and will flow through the delivery passage to an outlet port 21. Fuel will only be displaced to the outlet port providing the spill control valve 24 is closed and hence this valve is used to determine the quantity of fuel which is supplied by the apparatus to the associated engine at each injection stroke. As the distributor member rotates, the delivery passage 20 moves out of register with the outlet port 21 and an inlet passage 22 moves into register with the inlet port 22A. Fuel is therefore supplied to the bore 13 to effect full outward movement of the plungers 14 and the associated cam followers, as permitted by the cam lobes or by stop plates not shown. During continued rotation of the distributor member the inlet passage 22 is moved out of register with the inlet port 22A and the delivery passage 20 moves into register with the next outlet port 21 so that fuel is supplied to the outlet ports in turn during successive inward movements of the pumping plungers.

The timing of delivery of fuel is varied by moving the cam ring 17 angularly within the housing and this is effected in known manner by means of a fluid pressure operable piston 25 which is housed within a cylinder and which is spring biased in the retard direction. Fuel can be admitted to the cylinder directly from the source 22B or alternatively and as shown, an electrically operated valve 26 is provided and this is controlled by the control system 24A.

The control system 24A in order that it can control the operation of the spill control valve 24 needs to be supplied with signals indicative of the speed of the associated engine and also the position of the distributor member relative to the cam ring 17. A first transducer 27 of the variable reluctance type is provided and this is fixed to the housing and senses the passage of indicia 28 formed on the enlarged portion 18 of the drive shaft. In FIG. 1 the indicia are in the form of grooves cut into the periphery of the drive shaft at equally spaced intervals about the drive shaft. A further transducer 29 is provided and this is attached to the cam ring 17 and is also of the variable reluctance type. The transducer 29 is also responsive to the passage of the indicia 28. A disadvantage with the arrangement shown in FIG. 1 is that a flexible lead must be provided between the transducer 29 and a connector block which is not shown, mounted on the housing.

In order to overcome the problem of the flexible lead the transducer 29 is replaced by the arrangement which is shown in FIGS. 2 and 3 and referring to these Figures there is illustrated to enlarged scale, the enlarged portion of the drive shaft 18 and in this example the periphery of the drive shaft is provided with a plurality of teeth 30. The transducer which is generally indicated at 31 comprises a first pole component 32 in the form of an elongated arcuate member which is formed from magnetisable material and which at one end is provided with a pole tip 33 which extends into close proximity to the pole teeth 30. The pole tip as shown has a circumferential length corresponding to that of one tooth but it may define a number of teeth. The transducer also includes a second pole component in the form of a side plate 34 which is also formed from magnetisable material and which has an inner arcuate surface 35 which is located against with a small clearance, a plane cylindrical portion of the drive shaft. Interposed between the plate 34 and the member 32 is a permanent magnet 36. As the drive shaft rotates, the magnetic flux in the member 32 will vary as the teeth 30 pass the pole tip 33.

As shown in FIG. 2, a sensing coil 37 also forms part of the transducer and is located about the component 32. The sensing coil is wound upon a former which is supported by means of a bracket 38 on the housing of the apparatus. The opening in the former is shaped so that there is no contact between the component 32 and the former. The winding of the coil is connected by means of a lead to the aforesaid connector block and since the coil is fixed relative to the housing, the lead does not have to be constructed so as to accommodate movement. Also as shown in FIG. 2, the component 32 extends between and is secured to the ends of a split ring 39 which is secured to the cam ring 17 and which is formed from non-magnetic material.

The apparatus as described is of the type in which a distinct pair or more of pumping plungers is provided in a bore in the distributor member. The construction of transducer however is equally applicable to rotary distributor pumps of the type wherein the distributor member forms the pumping plunger and is therefore moved axially to achieve the pumping action and is rotated to effect distribution of the pumped fuel to the outlet ports. In such an arrangement the distributor member or a part connected thereto is provided with a face type cam ring which is engaged by rollers mounted in a carrier fixed axially within the housing. The carrier is angularly moveable to vary the timing of fuel delivery. In applying the construction of transducer to this type of pump, the component 32 together with the magnet and plate, would be mounted on the aforesaid carrier, and the sensing coil would be mounted on the housing. The plate 34 and the component 32 would be located in close proximity to a drive shaft of the apparatus.

With reference to FIGS. 4 and 5 the transducer comprises first and second annular pole components 40, 41 which are spaced by an annular permanent magnet 42. The component 40 has teeth formed on its internal surface corresponding to the teeth 30 on the drive shaft 18 and the component 41 has its inner surface running in close proximity to the surface of a plane portion of the drive shaft. The components 40, 41 and the magnet are apertured as shown in FIG. 5, to receive screws which hold the parts in assembly and to the cam ring.

The internal diameter of the magnet is large enough to accommodate an annular winding carried on an annular former 43 which is provided with outwardly extending lugs 44. The lugs enable the former to be mounted in the housing of the apparatus and one of the lugs carries the end connections of the coil to the aforesaid terminal block. The lugs 44 extend with clearance through slots 45 formed in one face of the magnet 42, the slots being of a circumferential length long enough to allow for the angular movement of the cam ring. The magnetic circuit of the transducer includes the drive shaft 18 about which the coil and former are located and as the drive shaft rotates cyclic variation of the magnetic flux flowing in the magnetic circuit takes place and a voltage is induced in the winding.

A further example is seen in FIGS. 6 and 7 and with reference to these figures, the drive shaft is shown at 18 and is provided with teeth 30. Also provided is a coil former 47 which is mounted on the housing of the pump by means of a bracket 46. The coil former is elongated in the direction of shaft rotation and formed in the former is an elongated slot 48. The former carries a winding 49 which is connected to the terminal block.

Extending in a generally radial direction through the slot 48 is a pole piece 50 which forms one of the pole components of the transducer and associated with the pole piece is a permanent magnet 51, the magnet and the pole piece being mounted on the cam ring so as to move angularly therewith. The pole piece is polarized by the magnet and the flux in the pole piece varies as the teeth 30 move adjacent to its tip. The slot 48 allows for movement of the pole piece 50 with movement of the cam ring about the axis of rotation of the drive shaft. In this case the face of the magnet remote from the pole piece forms the other pole component of the transducer which carries the return flux, the actual return flux path incorporating a substantial air gap.

I claim:

1. A fuel injection pumping apparatus for supplying fuel to an internal combustion engine comprising a housing (10) a cam actuated pumping plunger (14) slidable in a bore, means (11) for distributing fuel discharged from the bore during successive inward movement of the plunger to a plurality of outlet ports (21) in turn, a plunger actuating mechanism comprising a first part (18) which is mounted for rotation in the housing and which in use is driven in timed relationship with an associated engine to actuate the plungers, and a second part (17) mounted in the housing and being angularly adjustable therein about the axis of rotation of the first part to enable the timing of inward movement of the plunger to be varied and a transducer mounted on said second part and responsive to indicia on said first part characterised in that the transducer comprises first and second pole components (33, 34, 40, 41, 50), a magnet (36, 42, 51) acting to polarize said components to opposite magnetic polarity, the magnet and said components being mounted on said second part (17) and forming a magnetic circuit with said first part, said first part (18) and the one (33, 40, 50) of said components being shaped so that the flux flow in said magnetic circuit varies in a cyclic manner as the first part rotates in use, and a sensing coil (37, 43, 49) mounted on the housing (10) of the apparatus and surrounding a portion of the magnetic circuit to provide the output signal of the transducer.

2. An apparatus according to claim 1, in which said portion of the magnetic circuit comprises an arcuate member (32) which extends between the magnet (36) and said one (33) of said components, said arcuate member extending in the direction of rotation of said first part (18).

3. An apparatus according to claim 2, in which the opposite ends of said arcuate member (32) are secured to the ends of a split ring (39) formed from non-magnetic material.

4. An apparatus according to claim 3, in which said split ring (39) is adapted to be secured to said second part.

5. An apparatus according to claim 2, in which the other (34) of said components comprises a plate (34) having a surface which lies in close proximity to a surface of said first part (18).

6. An apparatus according to claim 1, in which said first and second components are defined by annular members (40, 41) and said magnet (42) is of annular form and is located between said members, said members and said magnet being located about said first part (18), said sensing coil being mounted on an annular former (43) located between said annular members (40, 41) and within said magnet.

7. An apparatus as claimed in claim 6, in which said former (43) is provided with outwardly extending lugs (44) which extend with clearance through slots (45) formed in the magnet (42) said lugs being utilised to secure the former to the housing (10).

8. An apparatus as claimed in claim 1, in which said one (50) of said components extends in a radial direction and said sensing coil (49) is wound upon a former (47) which is of elongated form in the direction of rotation of said first part (18), the former defining an elongated slot (48) through which said one of said components extends.

9. An apparatus as claimed in claim 1, in which said first part (18) is provided with a plurality of teeth (30) which define said indicia, about its periphery.

* * * * *